United States Patent [19]

Warnke et al.

[11] Patent Number: 4,633,498

[45] Date of Patent: Dec. 30, 1986

[54] INFRARED HEADPHONES FOR THE HEARING IMPAIRED

[75] Inventors: Egon F. Warnke; Klaus Willemsen, both of Wedemark, Fed. Rep. of Germany

[73] Assignee: Sennheiser Electronic KG, Wedemark, Fed. Rep. of Germany

[21] Appl. No.: 628,750

[22] Filed: Jul. 9, 1984

[30] Foreign Application Priority Data

Jul. 11, 1983 [DE] Fed. Rep. of Germany ..... 3325031

[51] Int. Cl.[4] ..... H04R 5/00; H04R 1/10

[52] U.S. Cl. ..... 381/23.1; 381/74; 381/25; 381/26

[58] Field of Search ..... 179/107 R; 381/25, 26.1, 381/74, 122

[56] References Cited

U.S. PATENT DOCUMENTS 4,192,969 3/1980 Iwahara ..... 381/1

FOREIGN PATENT DOCUMENTS 2552475 11/1975 Fed. Rep. of Germany ... 179/107 R
2431937 1/1976 Fed. Rep. of Germany .
58-181398 10/1983 Japan ..... 381/26

*Primary Examiner*—Forester W. Isen

[57] ABSTRACT

An infrared headphone with supplemental microphones to aid the hearing impaired allowing the user to hear the significant sounds from the ambient surroundings. In order to suppress the sound intensity of the user's own voice the invention provides for microphones arranged at a distance from each other on a supporting elbow in such a way that when they are mounted on the head of the user they are symmetrically arranged with respect to a median plane of the user's head and the signals emitted from the microphones are conducted in counter-phase with respect to each other.

7 Claims, 4 Drawing Figures

INFRARED HEADPHONES FOR THE HEARING IMPAIRED

BACKGROUND OF THE INVENTION

The invention relates to an infrared headphone which consists of two sound reproducers which are preferably connected to each other mechanically by means of a flexible elbow.

Infrared headphones of this type are known. See, e.g. German Pat. No. 2431937. In general infrared headphones are used for wireless sound transmission, for example from a television receiver or high-fidelity system to the listener. A further area of use is in classrooms for students with impaired hearing or at conferences involving many participants. Moreover, the use of infrared installations in theaters and cinemas has become popular. In particular, these installations are used to accommodate patrons with impaired hearing.

Known systems have the disadvantage that users with impaired hearing find a sense of isolation from the surrounding environment since the acoustic events in the immediate vicinity are difficult to perceive when the infrared headphones are used. For this reason, in accordance with the above-identified German Pat. No. 2431937, infrared headphones have been equipped with supplemental microphones and amplifiers which allow the user to selectively mix sound information received from the infrared transmission with sound information received from the microphones.

When using such a supplemental microphone with an infrared headphone device a significant drawback has been observed. Despite the infrared headphone being so equipped there are severe limitations regarding the amount of amplification of the signal supplied by the supplemental microphones. This is because the microphones are close to the mouth of the user so that his own voice is amplified. Since the microphones are also close to the sound reproducing elements of the headphone feedback is also a problem.

It is therefore an object of this invention to provide an improved arrangement for an infrared headphone with supplemental microphones such that the amplification of the microphone signals is not so limited, thus allowing the user to hear important sound events in his proximate environment while at the same time filtering out unimportant sounds and the user's own voice.

SUMMARY OF THE INVENTION

In accordance with the present invention the aforementioned object is achieved with an infrared headphone of the afore-described type in that two microphones are arranged at a distance from each other in a supporting elbow. The elbow is arranged so the microphones are mounted symmetrically along a median plane of the headphone. In addition, the signals from the microphones are conducted in counter-phase to each other.

Counter-phase switching techniques are known in the art of stereo transmission circuit arrangements. A drawback of the known methods, however, is that the listener perceives a so-called hole or dead sound space between the left and right channels. Attempts have been made to reduce this acoustic drawback by means of phase and frequency adjustments of the prevailing mixed information. The present invention now uses this drawback to advantage with regard to the signals from supplemental microphones being mixed with the infrared transmitted signal to the headphones.

Since the microphones are arranged symmetrically with respect to the median plane of the head of the user, sensitivity of the microphones to the user's own voice can be almost completely eliminated by virtue of counter-phase switching.

BRIEF DESCRIPTION OF THE DRAWINGS

With these and other objects in view, which will become apparent in the following detailed description, the present invention, which is shown by example only, will be clearly understood in connection with the accompanying drawings, in which.

DETAILED DESCRIPTION OF THE DRAWINGS

Figure 1:
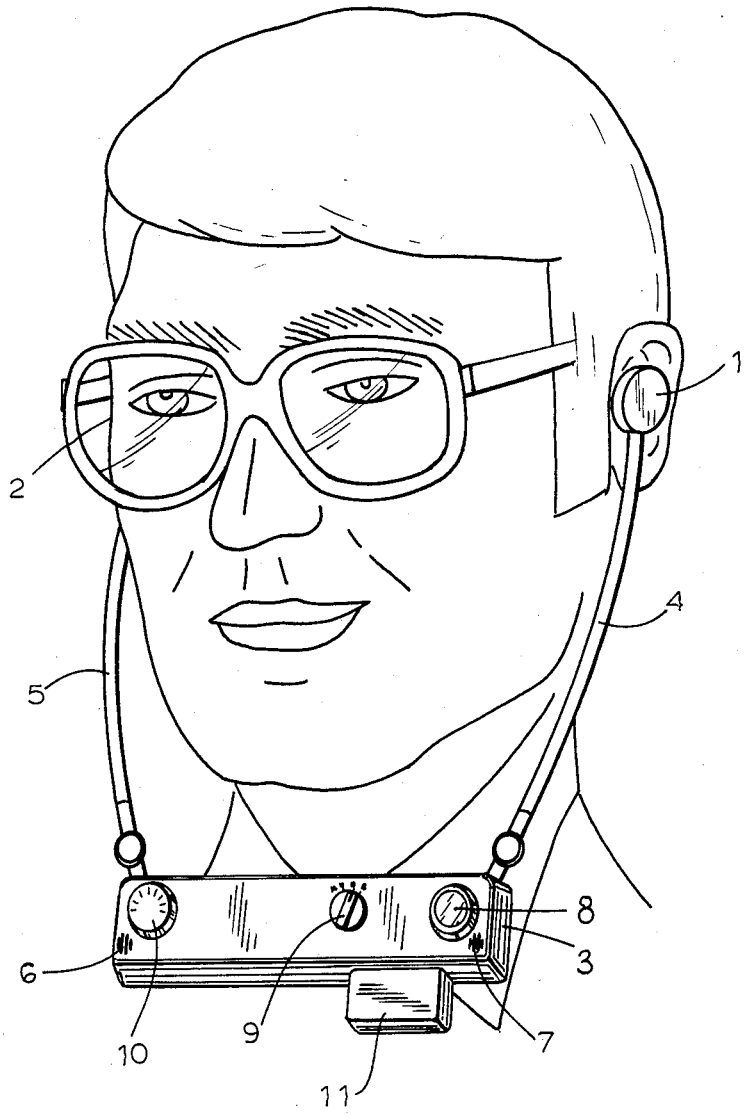
FIG. 1 is a perspective view of an infrared headphone in accordance with the present invention.

FIG. 1 illustrates an infrared headphone of elbow design. The elbow which mechanically connects the sound reproducers 1 and 2 consists of a base housing 3 and elbow ends 4 and 5 which contain electrical connections to the sound reproducers 1 and 2. The base housing 3 contains the electronic circuits (see FIGS. 2 and 3), microphones disposed behind openings 6 and 7, an infrared diode 8 for receiving infrared radiation, a function selector switch 9, and a volume control 10. The current supply 11 for the electronic circuit can be unplugged from the housing 3.

Figure 2:
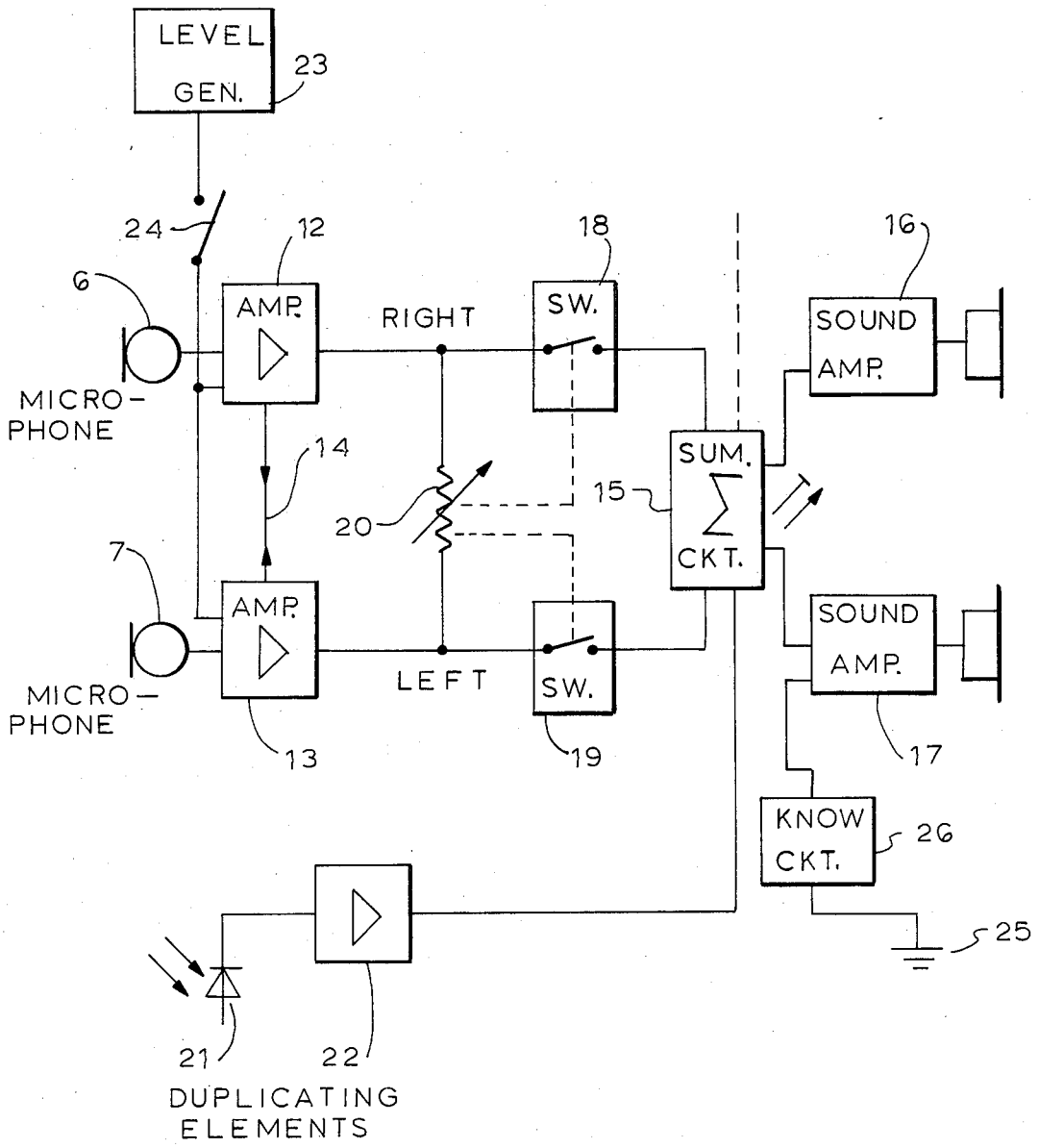
FIG. 2 is a block circuit diagram.

FIG. 2 shows a block circuit diagram of the present invention. Microphones 6 and 7 are amplified by microphone amplifiers 12 and 13. Reference number 14 illustrates a connection between these amplifiers which causes the signals emitted from the microphones to be counter-phase with respect to each other. Therefore, signals from sound waves which symmetrically impinge on microphones 6 and 7 interfere with each other destructively such that those signals are not significantly amplified.

Figure 3:
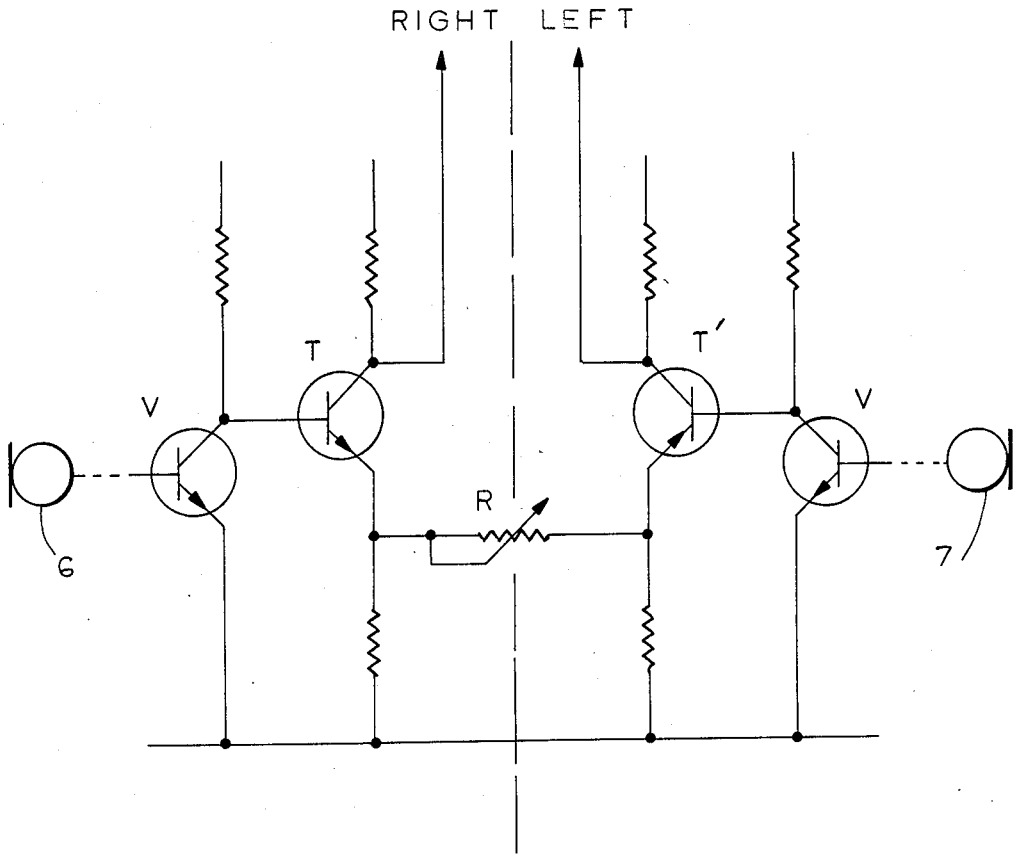
FIG. 3 is a detailed circuit diagram.

A particularly advantageous switching arrangement for amplification and counter-phase coupling of the microphone signals is illustrated in principle in FIG. 3. The voltages which are emitted from microphones are conducted to pre-amplifier stage V and V' and are further amplified by transistors T and T'. The left and right channel transistors furnish, in their joint switching via an emitter-coupling, a differential amplifier circuit. Equal phase signals conducted to amplifier stages V and V' are suppressed, whereas signals which are preponderant in either the left or right channel alone are further conducted in an amplified condition.

It has been found to be advantageous to only reduce the signal representing the speech of the hearing impaired user rather than to completely eliminate it. The suppression of these signals can be controlled by resistor R in the circuit shown in FIG. 3.

Referring again to FIG. 2, the microphone output signals R and L are conducted to the terminal stage amplifiers 16 and 17 via a summation circuit 15. These signals traverse threshold value switches 18 and 19 which are shown in FIG. 2 as switch contacts, but which may be constructed of electronic circuits including amplitude valuation circuits which conduct the corresponding microphone output signals. This represents an advantageous enhancement of the circuit according to the invention whereby it is possible to conduct sounds from the microphones to the sound reproducers only when they have reached a certain intensity.

The summation circuit 15 conducts to the sound reproducers via sound amplifiers 16 and 17 information from the microphones and the infrared channel.

FIG. 2 shows a monophonic infrared transmission path. However, stereophonic infrared transmission can be constructed by duplicating elements 21 and 22 and connecting the duplicated elements to summation circuit 15 as shown by the interrupted line extending from the top of summation circuit 15. Monophonic embodiments can consist of an infrared sensitive diode 21 and circuit arrangement 22 in which the signals emitted from the diode 21 are amplified and converted into audio signals. Summation circuit 15 contains switching members for adjusting the sound intensity as well as the balance between left and right channels. The circuit can be supplemented with a level generator 23, the signals of which are fed over switch 24 to microphone amplifiers 12, 13, in order to facilitate the balance setting.

The hearing impaired user can therefore perceive information transmitted via the infrared channel and, by means of threshold value switches 18 and 19 with their control adjustment 20, normal sounds of the ambient surrounding can be eliminated while maintaining the transmission of high intensity sounds from the ambient surrounding. If, for example, another person approaches the headphone user for purposes of conversation, that speech information will be transmitted to the sound reproducers of the headphone and mixed with the sound received via the infrared path since the sound surpasses the threshold volume of the switches 18 and 19.

In order to receive a good stereophonic reproduction of sound events in the ambient surroundings, the microphones are arranged in a fork in elbow housing 3 of FIG. 1 at approximately the same distance from each other as the distance between the ears of a user. The natural distance between ears is approximately 135 mm which has been determined by examining a large sample and which corresponds to an optimum stereo base width.

Figure 4:
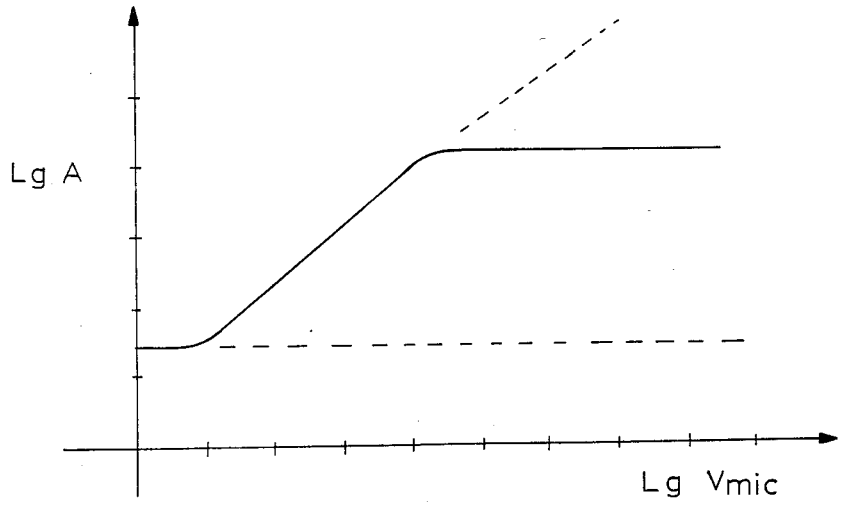
FIG. 4 is a graph of the initial progressive increase of amplification.

Moreover, the microphone amplifiers can be of the type which increase amplification in response to a higher microphone input voltage. This further enhances the limiting of low level unimportant ambient sounds while providing ample amplification for important high level sounds. For example, the amplification graph shown in FIG. 4 shows how this is achieved.

Additional modifications can be made to the basic design of the present invention. For example, a known circuit 26 can be added such that an audible signal is transmitted to the sound reproducers when the current source 25 is nearly depleted. This would allows the user to exchange current source modules at the most appropriate time.

Although the invention is described and illustrated with reference to a plurality of embodiments thereof, it is to be expressly understood that it is in no way limited to the disclosure of such preferred embodiments but is capable of numerous modifications within the scope of the appended claims.

We claim:

1. An infrared headphone for the hearing impaired comprising two sound reproducers mechanically joined by an elbow, said elbow containing an electronic circuit which receives infrared signals and converts said infrared signals into audio signals, said elbow also containing two microphones and two microphone amplifiers, said electronic circuit and said amplifier connected in such a way that signals from said electronic circuit and signals from said amplifier may be selectively mixed and conducted to said sound reproducers; said microphones being arranged at a distance from each other in said elbow such that said microphones lie symetrically with respect to a median plane bisecting the head of a person wearing said headphone, thereby said microphones being equidistant from the mouth of a person wearing said headphone; said microphones and said microphone amplifiers being connected such that the signals from one microphone are conducted to said sound reproducers in counter-phase to the signals from the other microphone, thereby suppressing the reproduction of sound eminating from the mouth of the person wearing said headphone.

2. An infrared headphone as in claim 1 wherein said microphones are arranged approximately 135 mm apart.

3. An infrared headphone as in claim 1, wherein said microphone amplifiers incorporate threshold value circuits which conduct signals from said microphones to said sound reproducers only when said signals surpass a preselected sound level.

4. An infrared headphone according to claim 1, wherein said microphone amplifiers increase amplification in response to a higher microphone input voltage, thereby suppressing the amplification of low level sounds.

5. An infrared headphone according to claim 1, wherein said microphone amplifiers and said electronic circuit include a level generator for balance compensation.

6. An infrared headphone according to claim 1, wherein the counter-phase coupling of said microphones is effected via a differential amplification circuit.

7. An infrared headphone according to claim 1, further comprising a second electronic circuit connected to at least one sound reproducer and which produces a warning signal when the supply voltage of a current supply source diminishing to a preselected low level.

* * * * *